US010557599B2

(12) United States Patent
Terumichi

(10) Patent No.: US 10,557,599 B2
(45) Date of Patent: Feb. 11, 2020

(54) LIGHTING APPARATUS

(71) Applicant: MODULEX INC., Tokyo (JP)

(72) Inventor: Goro Terumichi, Tokyo (JP)

(73) Assignee: MODULEX INC., Tokyo (JP)

( * ) Notice: Subject to any disclaimer, the term of this patent is extended or adjusted under 35 U.S.C. 154(b) by 0 days.

(21) Appl. No.: 16/069,725

(22) PCT Filed: Jan. 16, 2017

(86) PCT No.: PCT/JP2017/001228
§ 371 (c)(1),
(2) Date: Jul. 12, 2018

(87) PCT Pub. No.: WO2017/122824
PCT Pub. Date: Jul. 20, 2017

(65) Prior Publication Data

US 2019/0017666 A1 Jan. 17, 2019

(30) Foreign Application Priority Data

Jan. 16, 2016 (JP) ..... 2016-006704

(51) Int. Cl.
*F21S 8/00* (2006.01)
*F21S 8/02* (2006.01)
(Continued)

(52) U.S. Cl.
CPC ..... *F21S 8/02* (2013.01); *F21S 8/026* (2013.01); *F21V 7/0025* (2013.01); *F21V 7/04* (2013.01); *F21V 7/08* (2013.01); *F21V 11/10* (2013.01)

(58) Field of Classification Search
CPC ..... F21V 7/041; F21V 7/043; F21V 7/045; F21V 7/08; F21V 7/09; F21V 7/0025; F21S 8/02; F21S 8/026
See application file for complete search history.

(56) References Cited

U.S. PATENT DOCUMENTS 5,803,593 A * 9/1998 Siminovitch ..... F21V 7/0008 313/234
6,068,388 A * 5/2000 Walker ..... F21V 7/0025 362/263
(Continued)

FOREIGN PATENT DOCUMENTS

CN 105180024 A 12/2015
EP 2650597 A2 10/2013
(Continued)

OTHER PUBLICATIONS

The extended European search report (EESR) dated May 10, 2019 in a counterpart European patent application.

*Primary Examiner* — Gerald J Sufleta, II
(74) *Attorney, Agent, or Firm* — Metrolex IP Law Group, PLLC

(57) ABSTRACT

An illumination apparatus includes: a reflector having a first reflection surface with a shape of a surface of revolution, and a downward light emission outlet through which direct light from a light source and reflection light from the first reflection surface being emitted; and a cone having a substantially truncated conical second reflection surface, an upper opening opposing the light emission outlet, and a lower opening having a larger diameter than the upper opening. The cone is positioned outside the optical paths of the controlled reflection light from the first reflection surface.

5 Claims, 7 Drawing Sheets

(51) Int. Cl.

| | |
|---|---|
| ***F21V 7/08*** | (2006.01) |
| ***F21V 11/10*** | (2006.01) |
| ***F21V 7/04*** | (2006.01) |
| ***F21V 7/00*** | (2006.01) |

(56) References Cited

U.S. PATENT DOCUMENTS

| | | | | |
|---|---|---|---|---|
| 6,558,032 | B2 * | 5/2003 | Kondo | F21V 7/0091 362/516 |
| 2009/0231856 | A1 * | 9/2009 | Householder | F21V 7/0025 362/304 |
| 2012/0314404 | A1 * | 12/2012 | Harshaw | F21S 9/037 362/183 |
| 2013/0200407 | A1 * | 8/2013 | Roth | F21V 7/0016 257/91 |
| 2014/0334126 | A1 * | 11/2014 | Speier | F21V 7/0091 362/84 |
| 2016/0091174 | A1 * | 3/2016 | Hiki | F21S 41/336 362/297 |
| 2017/0254491 | A1 * | 9/2017 | Terumichi | F21S 8/026 |

FOREIGN PATENT DOCUMENTS

| | | | |
|---|---|---|---|
| JP | H5-15211 | U | 2/1993 |
| JP | H11-111017 | A | 4/1999 |
| JP | 2008-16417 | A | 1/2008 |
| JP | 2009-187773 | A | 8/2009 |
| JP | 2010-251206 | A | 11/2010 |
| JP | 2012-216305 | A | 11/2012 |
| JP | 2014-7102 | A | 1/2014 |
| WO | 2008/009166 | A1 | 1/2008 |
| WO | 2014/061157 | A1 | 4/2014 |
| WO | 2015/181413 | A1 | 12/2015 |

* cited by examiner

LIGHTING APPARATUS

TECHNICAL FIELD

The present invention relates to a lighting apparatus that comprises a reflector and a cone.

BACKGROUND

In the field of lighting apparatus, a downlight that comprises a reflector and a cone is known (for example, see Patent Document 1).

Patent Document 1 indicates that an object of an invention according Patent Document 1 is "to provide a downlight, in which a light transmission opening has a smaller diameter, and which can make the presence as a lighting apparatus less noticeable, and with which excellent designability can be obtained."

Patent Document 1 describes a means for achieving this object as follows: "The downlight of the present invention comprises: an elliptical reflection plate (reflector) having an ellipsoidal shape; a light source lamp disposed in an internal space of the elliptical reflection plate; a substantially cylindrical structure disposed at a lower portion of the elliptical reflection plate, and having a shape whose diameter is gradually decreased from its upper end to its lower end; and a cone portion (cone) disposed at a lower portion of a light transmission opening at a lower end of the substantially cylindrical structure, and having a substantially cylindrical shape whose diameter is gradually increased toward its lower portion."

PRIOR ART

Patent Document

Patent Document 1: JP-A-2008-16417

SUMMARY OF THE INVENTION

Problems to be Solved by the Invention

In the invention according to Patent Document 1 described above, the light that goes out from the light source lamp and is reflected by the elliptical reflection plate is effectively used for lighting purpose as controlled (controllable) light, but the light that goes out from the light source and then hits the substantially cylindrical structure is not be used for lighting purpose, and thus efficiency is reduced accordingly.

The present invention is provided in view of the issues described above, and an object is to provide a lighting apparatus having a structure, in which controlled reflection light is efficiently emitted from the lighting apparatus, and in which the controlled reflection light does not hit a cone, thereby glare in the cone is suppressed.

Means for Solving the Problems

The invention according to claim 1 is characterized in that a lighting apparatus comprises: a light source; a reflector having a first reflection surface with a shape of a surface of revolution, and having a downward light emission outlet through which direct light from the light source and reflection light from the first reflection surface being emitted; and a cone having a substantially truncated conical second reflection surface, an upper opening opposing the light emission outlet, and a lower opening having a larger diameter than the upper opening, wherein the cone is disposed outside optical paths of controlled reflection light from the first reflection surface.

The invention according to claim 2 is characterized in that, in the lighting apparatus according to claim 1, the second reflection surface has a shape being linear or curved concave toward the optical axis of the light source, in a cross section cut along a plane including the optical axis.

The invention according to claim 3 is characterized in that, in the lighting apparatus according to claim 1, the light source has a planar light-emitting surface, and when a line that connects an inner periphery edge of the upper opening and an inner periphery edge of the lower opening, which are respectively located on one side with respect to the optical axis in the cross section cut along a plane including the optical axis of the light source, is defined as a first reference line, and when a line that connects an inner periphery edge of the upper opening and an inner periphery edge of the lower opening, which are respectively located on the other side with respect to the optical axis in the cross section cut along a plane including the optical axis of the light source, is defined as a second reference line, then the light-emitting surface is disposed in a region interposed between the first reference line and the second reference line after these reference lines intersect with each other.

The invention according to claim 4 is characterized in that, in the lighting apparatus according to claim 3, the first reflection surface has a spheroidal shape that is obtained by revolving a portion of an ellipse that has its major axis on the optical axis, wherein its upper first focal point is disposed at the center of the light-emitting surface, and its lower second focal point is disposed lower than the upper opening of the cone.

The invention according to claim 5 is characterized in that, in the lighting apparatus according to claim 1, the diameter of an inner periphery edge of the light emission outlet of the reflector and the diameter of an inner periphery edge of the upper opening of the cone are set to be substantially the same.

The invention according to claim 6 is characterized in that, in the lighting apparatus according to claim 5, the cone comprises: a cone body having the second reflection surface; and a ring shaped light-shielding member covering an inner periphery edge at an upper end of the cone body, wherein the diameter of the inner periphery edge of the light emission outlet is smaller than the diameter of the inner periphery edge at the upper end of the cone body, and greater than the diameter of an inner periphery edge of the light-shielding member that configures an inner periphery edge of the upper opening.

Effects of the Invention

According to the invention of claim 1, the cone does not require a portion that corresponds to the substantially cylindrical structure that was needed in the prior art. An area for the first reflection surface thus can be increased accordingly. As a result, the reduction in the amount of the controllable reflection light reflected by the first reflection surface can be prevented.

In addition, the cone is disposed outside the optical paths of the controlled reflection light from the first reflection surface, and thus the controlled reflection light from the first reflection surface does not hit the cone, and glare in the cone can be suppressed.

In addition, the cone can reduce spread reflection. Therefore a larger glare cut-off angle for the whole lighting apparatus can be obtained.

Controlled reflection light herein refers to reflected light as designed (intended). Uncontrollable reflection light herein refers to reflected light that may be called unintended reflection light (spread reflection light), for example, the light reflected by a defect in the first reflection surface or reflected by a lower edge of the first reflection surface of the reflector, or the light reflected by the first reflection surface multiple times.

According to the invention of claim 2, the second reflection surface has a shape being linear or curved concave toward the optical axis, when viewed in a cross section cut along a plane including the optical axis of the light source. As a result, among the spread reflection light (unintended reflection light), the light that hits the second reflection surface is more readily directed downward (for example, a direction to a floor surface) and less likely to cause glare than a case where the second reflection surface has a shape being curved convex toward the optical axis.

According to the invention of claim 3, the planar light-emitting surface of the light source is disposed in a region (angle range) interposed between the first reference line and the second reference line after these reference lines intersect with each other. Therefore, the direct light from the light-emitting surface will not hit the second reflection surface. In other words, the cone will not undesirably reduce the amount of direct light.

According to the invention of claim 4, the second focal point is disposed lower than the upper opening of the cone. As a result, the angle of light, which goes out from the light-emitting surface and is reflected by the first reflection surface and is then emitted from the lower opening of the cone, with respect to a level surface can be increased, and thus the light is less likely to hit the cone than a case where the second focal point is disposed in the upper opening, for example.

According to the invention of claim 5, the diameter of the inner periphery edge of the light emission outlet of the reflector and the diameter of the inner periphery edge of the upper opening of the cone are set to be substantially the same. The cone therefore will not undesirably reduce the direct light from the light source.

According to the invention of claim 6, the diameter of the inner periphery edge of the light emission outlet of the reflector is smaller than the diameter of the inner periphery edge at the upper end of the cone body, and greater than the diameter of the inner periphery edge of the light-shielding member that configures the inner periphery edge of an upper opening. Therefore, the cone can control light by shielding direct light near the outer periphery, without undesirably reducing the amount of direct light.

BRIEF DESCRIPTION OF THE DRAWINGS

FIG. 1 is a front view of the lighting apparatus 1 mounted on a ceiling surface C.

FIG. 2 is an oblique view of the lighting apparatus 1 viewed from obliquely above.

FIG. 3 is an oblique view of the lighting apparatus 1 viewed from obliquely below.

FIG. 4 is a view as seen in a direction of X-X arrow line in FIG. 1.

FIG. 5 is a view as seen in a direction of X-X arrow line in FIG. 1, and illustrates optical paths of controlled reflection light.

FIG. 6 is a view as seen in a direction of X-X arrow line in FIG. 1, and illustrates optical paths of uncontrollable reflection light (spread reflection light).

EMBODIMENTS FOR IMPLEMENTING THE INVENTION

Figure 1:
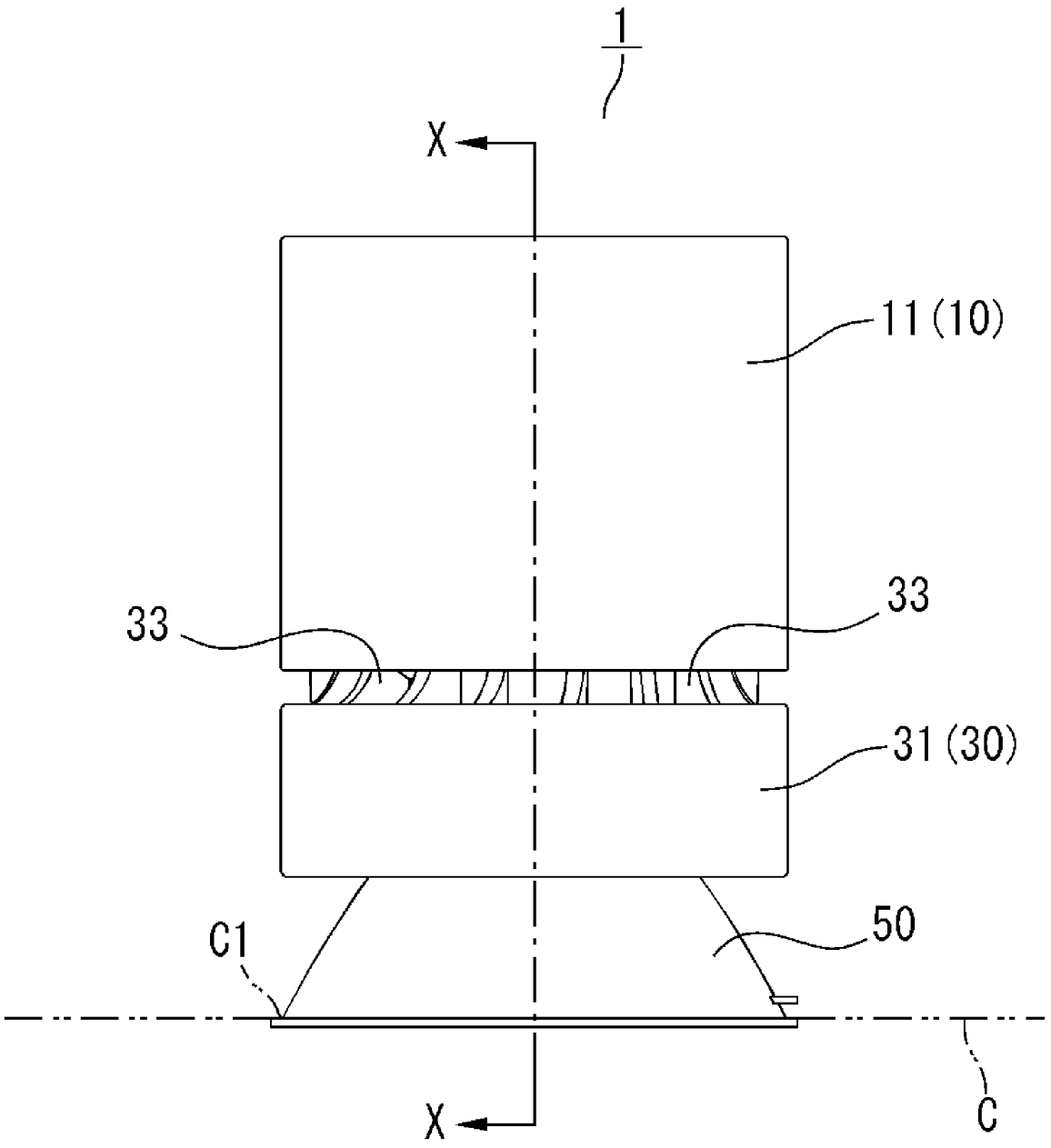
FIGS. 1 to 6 illustrate a lighting apparatus 1 of Embodiment 1.

Embodiments, to which the present invention is applied, are described in detail with reference to drawings. In the drawings, elements designated by a same numerical reference have a same or similar configuration, and duplicate explanation thereof is omitted. In addition, in the drawings, elements that are not necessary for explanation are omitted as appropriate.

Embodiment 1

A lighting apparatus 1 according to Embodiment 1, to which the present invention is applied, is described with reference to FIGS. 1 to 6.

Figure 2:
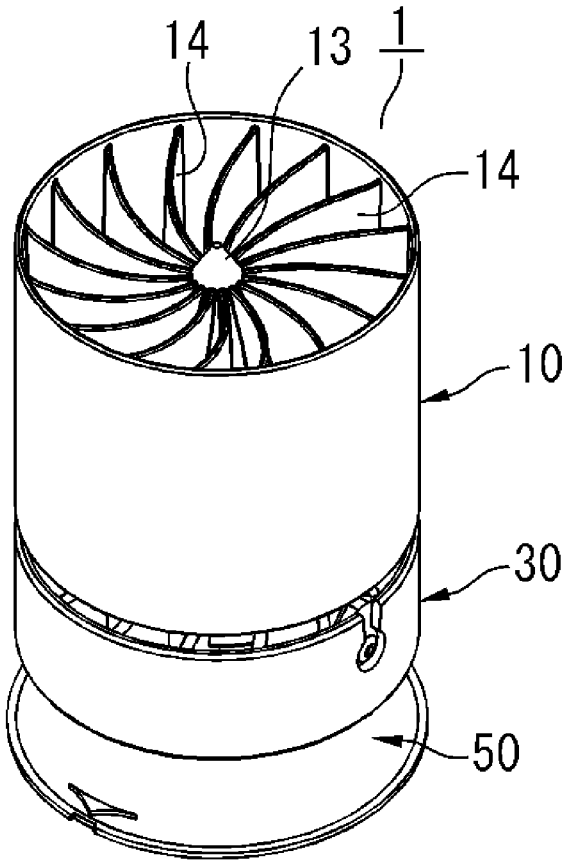
Figure 3:
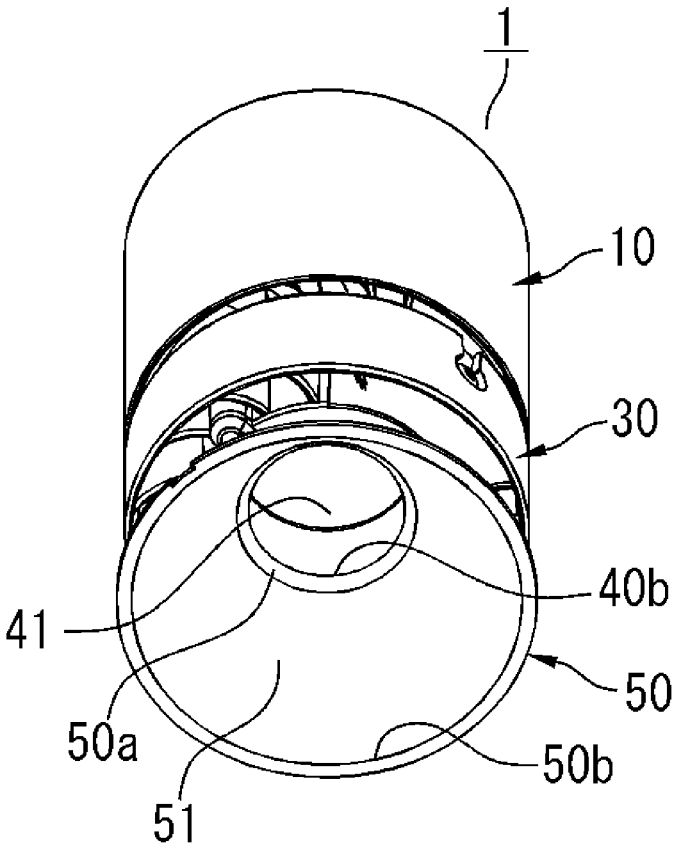
Figure 4:
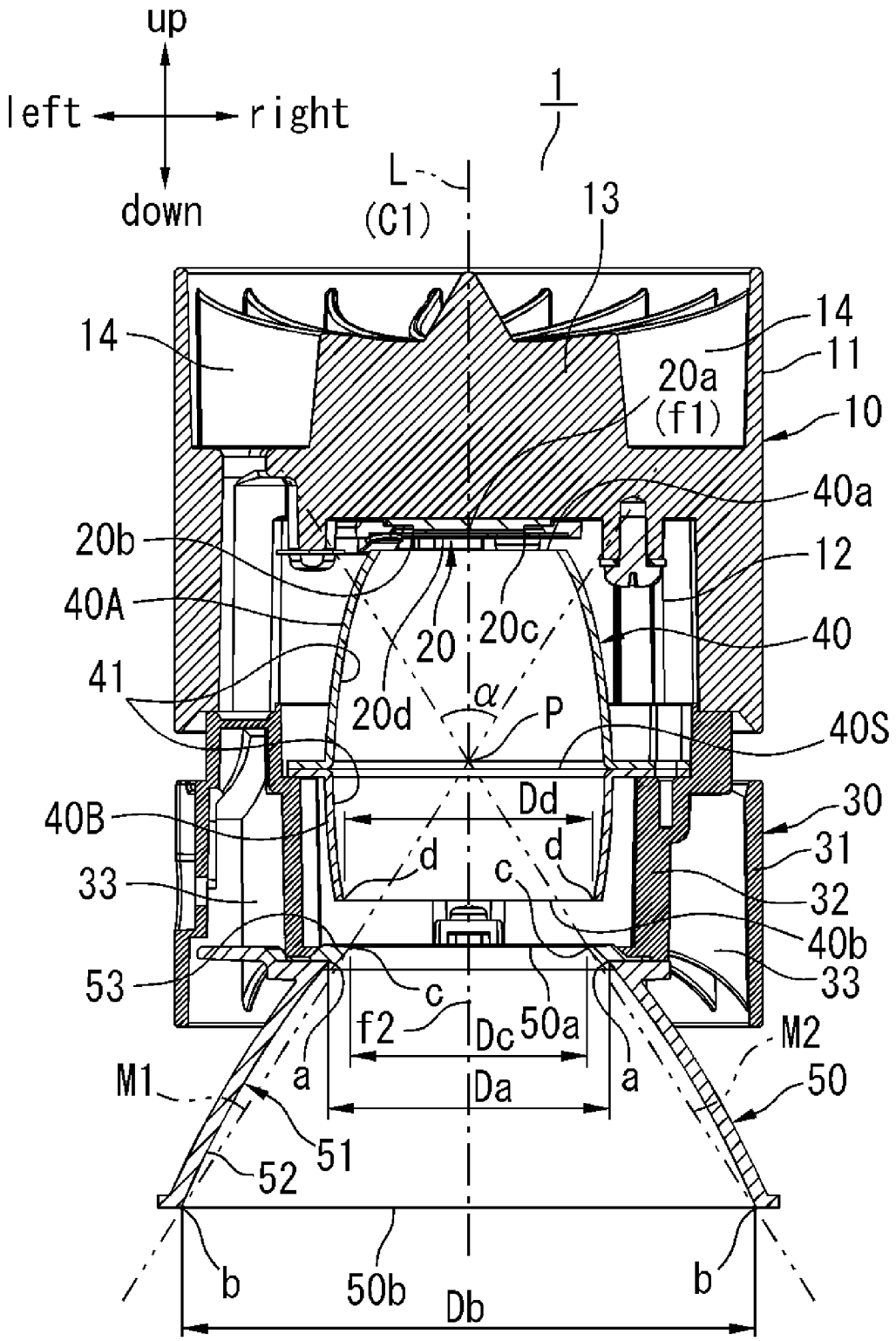
Figure 5:
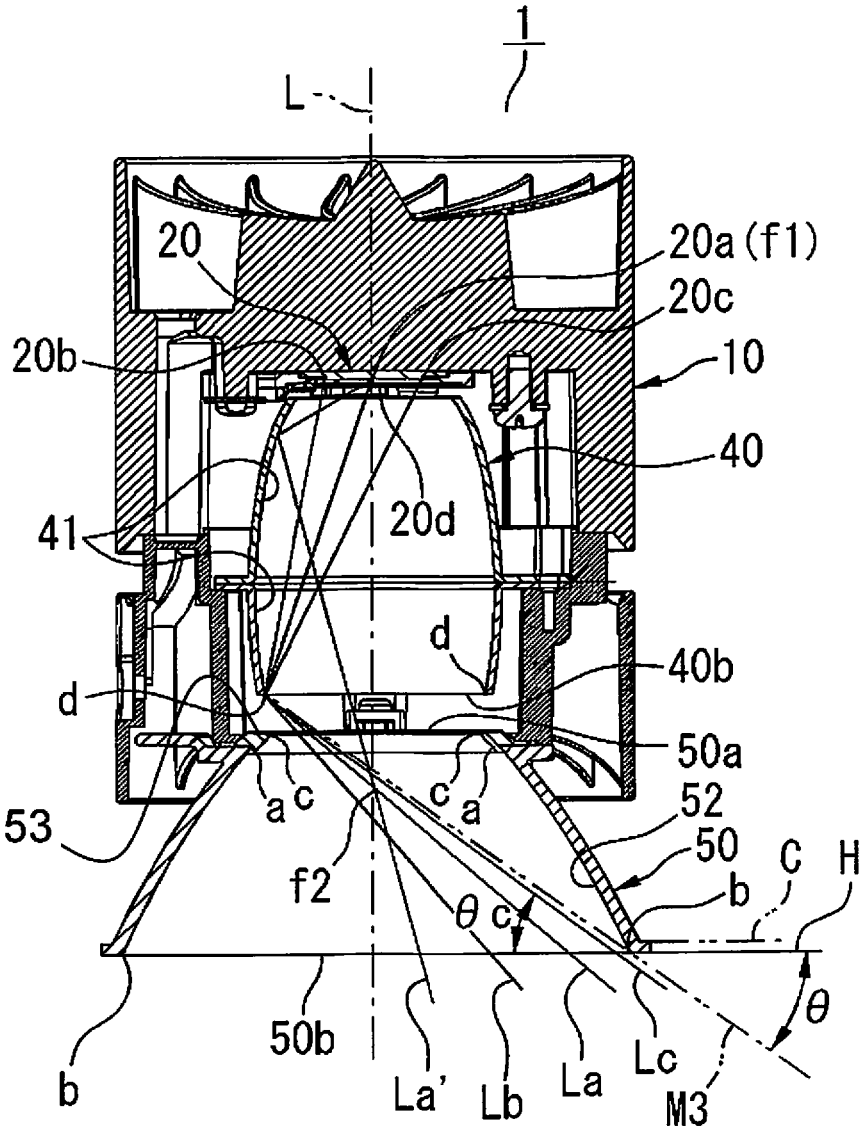
Figure 6:
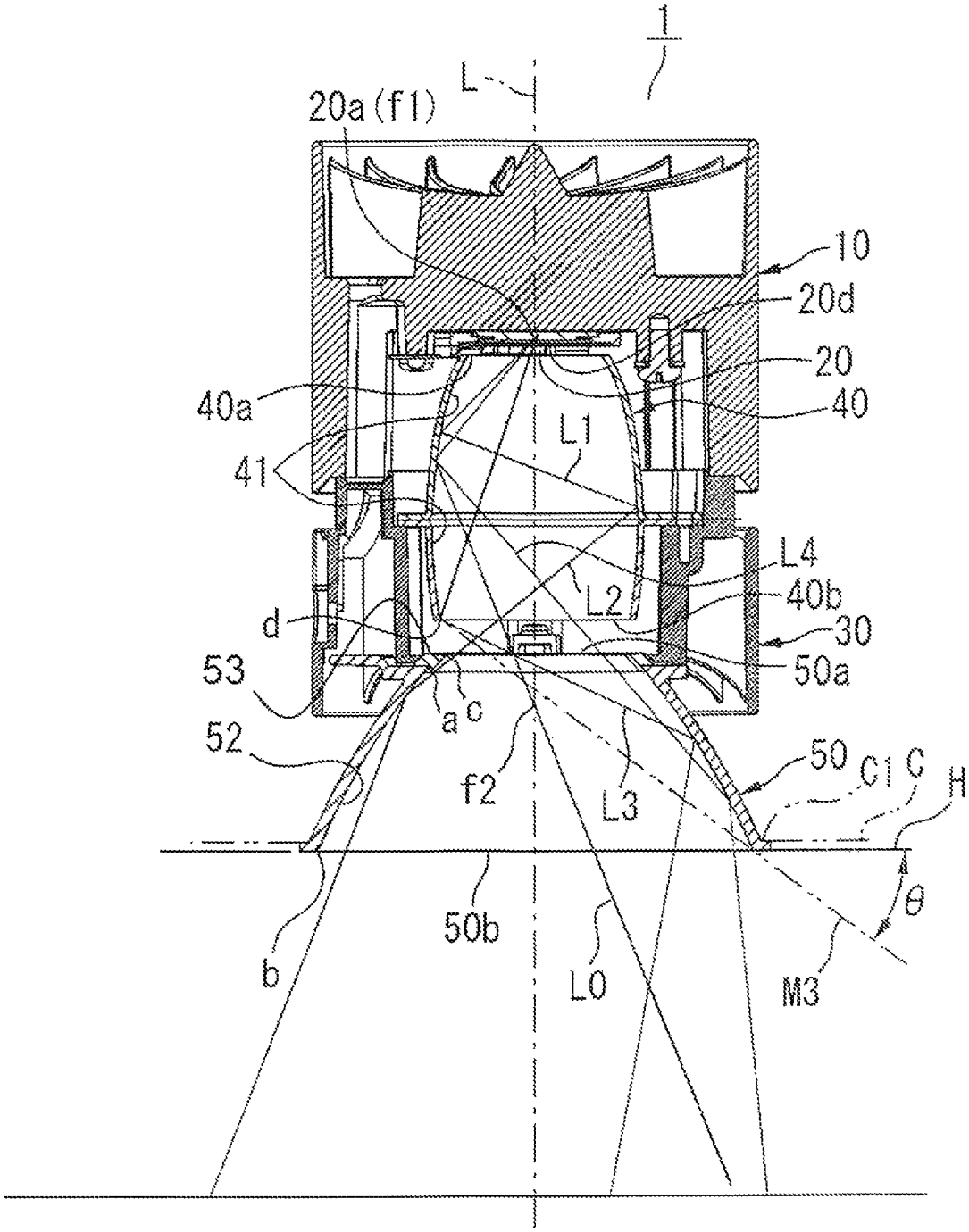

FIG. 1 is a front view of the lighting apparatus 1 mounted on a ceiling surface C. FIG. 2 is an oblique view of the lighting apparatus 1 viewed from obliquely above. FIG. 3 is an oblique view of the lighting apparatus 1 viewed from obliquely below. FIG. 4 is a view as seen in a direction of X-X arrow line in FIG. 1. FIG. 5 is a view as seen in a direction of X-X arrow line in FIG. 1, and illustrates optical paths of controlled reflection light. FIG. 6 is a view as seen in a direction of X-X arrow line in FIG. 1, and illustrates optical paths of uncontrollable reflection light (spread reflection light). In the description below, up, down, right, and left indicated by arrows in FIG. 4 correspond to up, down, right, and left directions of the lighting apparatus 1.

As illustrated in FIGS. 1 to 4, the lighting apparatus 1 has a substantially cylindrical shape centering on an optical axis L. The optical axis L coincides with a central axis C1 of the lighting apparatus 1.

The lighting apparatus 1 comprises a socket 10, a light source 20, a body 30, a reflector 40, and a cone 50.

As illustrated in FIG. 4, the socket 10 comprises a cylindrical outer wall 11, a cylindrical inner wall 12, a heat sink 13 for absorbing heat generated at the light source 20, and multiple heat dissipation fins 14 that are radially disposed and dissipate the heat from the heat sink 13.

A planar light source having a planar light-emitting surface 20*d* can be used for the light source 20. Examples of the planar light source may include: for example, a COB (chip-on-board) type light source in which multiple LED elements are disposed in a planar arrangement; or multiple LED lamps disposed in a planar arrangement. The light source 20 is mounted to a lower surface of the heat sink 13. The light-emitting surface 20*d* is substantially circular, with its center 20*a* disposed on the optical axis L. In FIG. 4, outer periphery edges of the light-emitting surface 20*d* are designated as end portions 20*b*, 20*c*, each at an equal distance from the center 20*a*.

The shape of the light-emitting surface 20*d* of the light source 20 is not limited to the substantially circular shape as described above, and may be any other shape, such as a square. In addition, the light source 20 may be a point light source. Examples of the point light source may include, for example, a halogen lamp, an HID, or the like.

The body 30 comprises a cylindrical outer wall 31, a cylindrical inner wall 32, and multiple heat dissipation fins 33 disposed between the outer wall 31 and inner wall 32. A lower end of the socket 10 described above is secured to an upper end of the body 30.

The reflector 40 has a spheroidal (substantially a barrel-like) shape. The reflector 40 is accommodated, positioned, and secured inside the inner wall 12 of the socket 10 and the inner wall 32 of the body 30.

In the present embodiment, the reflector 40 comprises an upper block 40A and a lower block 40B, which are combined and secured at a junction surface 40S to configure the whole reflector 40. The position of the junction surface 40S coincides with the minor axis (not shown) of an ellipse described later that is used as a base. The reflector 40 in the present embodiment comprises the upper block 40A and the lower block 40B combined at the junction surface 40S as described above, for convenience in manufacturing. However, theoretically, the reflector 40 may be integrally formed as a whole.

The reflector 40 has a light incidence inlet (opening) 40*a* at an upper end (base end side), and a downward light emission outlet (opening) 40*b* at a lower end (tip end side). The light from the light source 20 enters through the light incidence inlet (opening) 40*a*, and the light is emitted from the downward light emission outlet (opening) 40*b*.

As illustrated in FIGS. 4 and 5, a first reflection surface 41 having a spheroidal shape (surface of revolution) is formed on an inner periphery surface of the reflector 40. The first reflection surface 41 is contiguous both on an inner periphery surface of the upper block 40A and on an inner periphery surface of the lower block 40B.

As illustrated in FIG. 4, the first reflection surface 41 has a spheroidal shape that is obtained by revolving a portion of an ellipse being used a base around the optical axis L. The ellipse has its major axis (not shown) on the optical axis L in a cross section cut along a plane including the optical axis L (hereafter simply referred as "the cross section"). This ellipse used as a base has the major axis on the optical axis L, and its upper first focal point f1 coincides with the center 20*a* of the light source 20, and its lower the second focal point f2 is disposed lower than the light emission outlet 40*b*, and also lower than an upper opening 50*a* of the cone 50 described below.

The light, which goes out from the center 20*a* of the light source 20 and is reflected by the first reflection surface 41, results in controlled reflection light (intended reflection light as designed). The controlled reflection light is emitted from the light emission outlet 40*b*, and goes into the upper opening 50*a* of the cone 50 described below, and passes through the second focal point f2, and is emitted from a lower opening 50*b* of the cone 50. Among the light that goes out from the center 20*a* of the light source 20, the light that hits a lower portion of the first reflection surface 41 exhibits a greater emission angle with respect to the optical axis L, after its reflection. In other words, the emission angle of reflection light is maximized for light incident in close proximity to an inner periphery edge d at a lower end (the lower end of the first reflection surface 41) of the reflector 40 in FIG. 4, excepting the inner periphery edge d itself. As used below, "in close proximity to the inner periphery edge d" does not include the inner periphery edge d itself. The light that goes out from the light source 20 and hits the inner periphery edge d results in uncontrollable reflection light (spread reflection light).

The cone 50 is now described in detail with reference to FIGS. 4 and 5.

The cone 50 comprises a substantially truncated conical second reflection surface 52, the upper opening 50*a* opposing the light emission outlet 40*b* of the reflector 40, and the lower opening 50*b* having a larger diameter than the upper opening 50*a*.

As illustrated in FIG. 4, the cone 50 further comprises a cone body 51 having a substantially "inverted and truncated V" shape when viewed in the cross section, and a ring shaped light-shielding member 53 covering an inner periphery edge a at an upper end of the cone body 51.

The cone body 51 has a substantially truncated conical cylindrical shape. The second reflection surface 52 is formed on an inner periphery surface of the cone body 51 throughout its entire surface. Inner periphery edges a, b are formed at an upper end and a lower end of the cone body 51, respectively. The inner periphery edge b at the lower end of the cone body 51 is an inner periphery edge of the lower opening 50*b* of the cone 50. The diameter of the inner periphery edge of the cone body 51 is the minimum at the inner periphery edge a at the upper end, and becomes greater at a lower portion, and is the maximum at the inner periphery edge b at the lower end.

In addition, the second reflection surface 52 has a shape slightly curved concave toward the optical axis L, on the cross section. In other words, when a virtual straight line (not shown) is defined that connects the inner periphery edges a and b of the cone body 51, which are located on one side (left side in FIGS. 4 and 5) with respect to the optical axis L, then the second reflection surface 52, excepting the inner periphery edges a and b themselves, is located outer from the line.

As illustrated in FIGS. 4 and 5, the light-shielding member 53 has a ring shape having a substantially parallelogram shape in cross section, and covers the inner periphery edge a at the upper end of the cone body 51. The material for the light-shielding member 53 may be rubber, for example. An inner periphery edge c of the light-shielding member 53 configures the upper opening 50*a* of the cone 50. In other words, in the lighting apparatus 1, the inner periphery edge c of the light-shielding member 53 and an inner periphery edge c of the upper opening 50*a* of the cone 50 are the same (coincide with each other).

In the present embodiment, the diameter Dd of the inner periphery edge d of the light emission outlet 40*b* of the reflector 40 and the diameter Dc of the inner periphery edge c of the upper opening 50*a* of the cone 50 are set to be substantially the same.

In more detail, when the diameter of the inner periphery edge a at the upper end of the cone body 51 is defined as Da, and the diameter of the inner periphery edge c of the light-shielding member 53 is defined as Dc, and the diameter of the inner periphery edge d of the light emission outlet 40*b* of the reflector 40 is defined as Dd, then the reflector 40 and the cone 50 are configured to satisfy a relation among these diameters Da, Dc, Dd of:

$Da \geq Dd \geq Dc$ (where $Da \neq Dc$).

This configuration enables the light-shielding member 53 to control light by shielding the direct light near the outer periphery edge that is irradiated radially from the light-emitting surface 20*d* of the light source 20, and to prevent light incident on the inner periphery edge a of the cone body 51 which otherwise causes spread reflection. This configuration minimizes the reduction in the amount of direct light as much as possible.

A virtual straight line that connects the inner periphery edge b of the lower opening 50*b* and the inner periphery edge c of the upper opening 50*a*, which are respectively located on one side (for example, left side) with respect to the optical axis L illustrated in FIG. 4, is now defined as a first reference line M1. Another virtual straight line that connects the inner periphery edge b of the lower opening 50*b* and the inner periphery edge c of the upper opening 50*a*, which are respectively located the other side (right side), is defined as a second reference line M2. When the first reference line M1 and the second reference line M2 are extended upward, they gradually approach each other, and intersect with each other at an angle α on a point P on the optical axis L, and after the intersection, the lines extend obliquely above being gradually spaced away from each other.

In the present embodiment, the point P is located near the junction surface 40S of the reflector 40 (substantially the midpoint between the first focal point f1 and the second focal point f2) in a vertical direction. This means that, in designing the cone 50, the first reference line M1 and the second reference line M2 can be determined, for example by previously determining the point P, a vertical position of the upper opening 50*a* of the cone 50, and the diameter Dc of the inner periphery edge c. By placing the inner periphery edge b of the lower opening 50*b* of the cone 50 on the first reference line M1 and the second reference line M2 that are determined as described above, the cone 50 can be basically designed.

In the present embodiment, the planar light-emitting surface 20*d* of the light source 20 is disposed within a region interposed between the first reference line M1 and the second reference line M2 after these reference lines intersect with each other at the point P (within the range of the angle α whose vertex is the point P).

With this configuration, even when a planar light source is used for the light source 20, the direct light from the light source 20 will not hit the second reflection surface 52, preventing occurrence of glare.

The light that goes out from the light source 20 and is reflected by the first reflection surface 41, which results in controlled reflection light, is described below with reference to FIG. 5.

In the present embodiment, the first reflection surface 41 has a spheroidal shape as described above. In FIG. 5, the first focal point f1 is disposed at the center 20*a* of the light source 20, and the second focal point f2 is disposed lower than the upper opening 50*a* of the cone 50.

The light that goes out from the center 20*a* (first focal point f1) of the light source 20 and is reflected by the first reflection surface 41 results in the controlled reflection light. The controlled reflection light is emitted from the light emission outlet 40*b* of the reflector 40, and goes into the upper opening 50*a* of the cone 50, and passes through the second focal point f2, and is emitted from the lower opening 50*b*.

For example, reflection light La' is the light that goes out from the center 20*a* of the light source 20 and then hits and is reflected from the highest portion of the first reflection surface 41. Reflection light La is the light that also goes out from the center 20*a* of the light source 20 and then hits and is reflected from the lowest portion (in close proximity to the inner periphery edge d) of the first reflection surface 41. Reflection light Lb is the light that goes out from the end portion 20*b* on one side (left side) of the light source 20, and is reflected in a portion in close proximity to the inner periphery edge d. Reflection light Lc is the light that goes out from the end portion 20*c* on the other side (right side) of the light source 20, and is reflected in a portion in close proximity to the inner periphery edge d.

A virtual straight line that connects the inner periphery edged on one side of the light emission outlet 40*b* of the reflector 40 and the inner periphery edge b on the other side of the lower opening 50*b* of the cone 50 is now defined as a third reference line M3. An angle formed by the third reference line M3 and a level surface H (ceiling surface C) is defined as a glare cut-off angle θ.

In the example illustrated in FIG. 5, an angle θc of the reflection light Lc with respect to the level surface H (=90 degrees−emission angle) is the smallest.

In the present embodiment, the light source 20, the reflector 40, and the cone 50 are configured to satisfy a relation of θc>θ, so that the light, which goes out from the light source 20 and is reflected by the first reflection surface 41 and thus results in the controlled reflection light, will not hit the second reflection surface 52.

In other words, the cone 50 is disposed outside the optical paths of the controlled reflection light from the first reflection surface 41. This ensures that the cone 50 will not reduce the amount of the controlled reflection light.

In the description above, the shape of the cone 50 in cross section is slightly concave curved. However, instead of this example, the shape may be linear, or may be convex curved.

The relation between the cone 50 and spread reflection light is described below with reference to FIG. 6.

As illustrated in FIG. 6, the light that is reflected by the first reflection surface 41 of the reflector 40 may include uncontrollable (unintended) spread reflection light, other than the controlled reflection light (reflection light as designed) described with reference to FIG. 5. Reflection light L0 in FIG. 6 is controlled reflection light.

Spread reflection light L1 in FIG. 6 is reflection light occurred by spread reflection, for example, due to a surface defect of the first reflection surface 41 of the reflector 40. Spread reflection light L2 is reflection light occurred by multiple reflections due to the spread reflection light L1 described above. Spread reflection light L3 is reflection light occurred by spread reflection at the inner periphery edge d (edge portion) of the reflector 40. Other examples of the spread reflection light may include reflection light occurring at the junction surface 40S (see FIG. 4) between the upper block 40A and the lower block 40B that make up the reflector 40.

As described above, in this embodiment, reduction in the amount of the controlled reflection light is prevented and efficient lighting can be achieved, by disposing the cone 50 outside the optical paths of the controlled reflection light. On the other hand, the glare cut-off angle θ is increased, and uncontrollable spread reflection light is reduced as much as possible, by disposing the cone 50 outside the optical paths of the controlled reflection light and also in the vicinity of the optical path.

In the present embodiment, the angle of the entire light emitted from the lighting apparatus 1 (including direct light, controlled reflection light, and spread reflection light) with respect to the level surface H is equal to or greater than the glare cut-off angle θ. The angle θ may be set to be equal to or greater than 30 degrees, for example.

Effects and advantages of the cone 50 described above are summarized below. Note that there is some duplication.

The cone 50 does not require a portion that corresponds to a substantially cylindrical structure that was needed in the prior art. Therefore, a larger area can be used for the first reflection surface 41, and the reduction in the amount of controllable reflection light can be prevented.

In addition, the cone 50 is disposed outside the optical paths of the controlled reflection light from the first reflection surface 41. Therefore, the reflection light from the first reflection surface 41 will not hit the cone 50, and glare in the cone 50 can be suppressed.

In addition, the cone 50 can reduce spread reflection, and thereby a larger glare cut-off angle θ for the whole lighting apparatus 1 can be obtained.

The second reflection surface 52 has a shape being linear or curved concave toward the optical axis in a cross section cut along a plane including the optical axis L of the light source 20. Therefore, the light that hits the second reflection surface is more readily directed, for example in a direction to a floor surface, and less likely to cause glare, than a case where the second reflection surface 52 is convex curved.

The light source 20 is disposed in a region interposed between the first reference line M1 and the second reference line M2 after the reference lines intersect with each other (within a range of the angle α). Therefore, the direct light from the light-emitting surface 20*d* will not hit the second reflection surface 52. In other words, the amount of direct light will not be undesirably reduced.

The diameter Dd of the inner periphery edge d of the light emission outlet 40*b* of the reflector 40 and the diameter Dc of the inner periphery edge c of the upper opening 50*a* of the cone 50 are set to be substantially the same. Therefore, the cone 50 will not undesirably reduce the direct light from the light source 20.

The second focal point f2 of the first reflection surface 41 is disposed lower than the upper opening 50*a* of the cone 50. Therefore, the angle θ of the light, which goes out from the light-emitting surface 20*d* and is reflected by the first reflection surface 41 and is emitted from the lower opening 50*b* of the cone 50, with respect to the level surface H can be greater, and the light is less likely to hit the cone 50, than a case where the second focal point f2 is disposed in the upper opening 50*a*, for example.

The diameter Dd of the inner periphery edge d of the light emission outlet 40*b* of the reflector 40 is smaller than the diameter of Da of the inner periphery edge a at the upper end of the cone body 51, and is greater than the diameter Dc of the inner periphery edge c of the light-shielding member 53. Therefore, the cone 50 will not undesirably reduce the amount of direct light, and can control light by shielding the direct light near the outer periphery edge.

Embodiment 2

Figure 7:
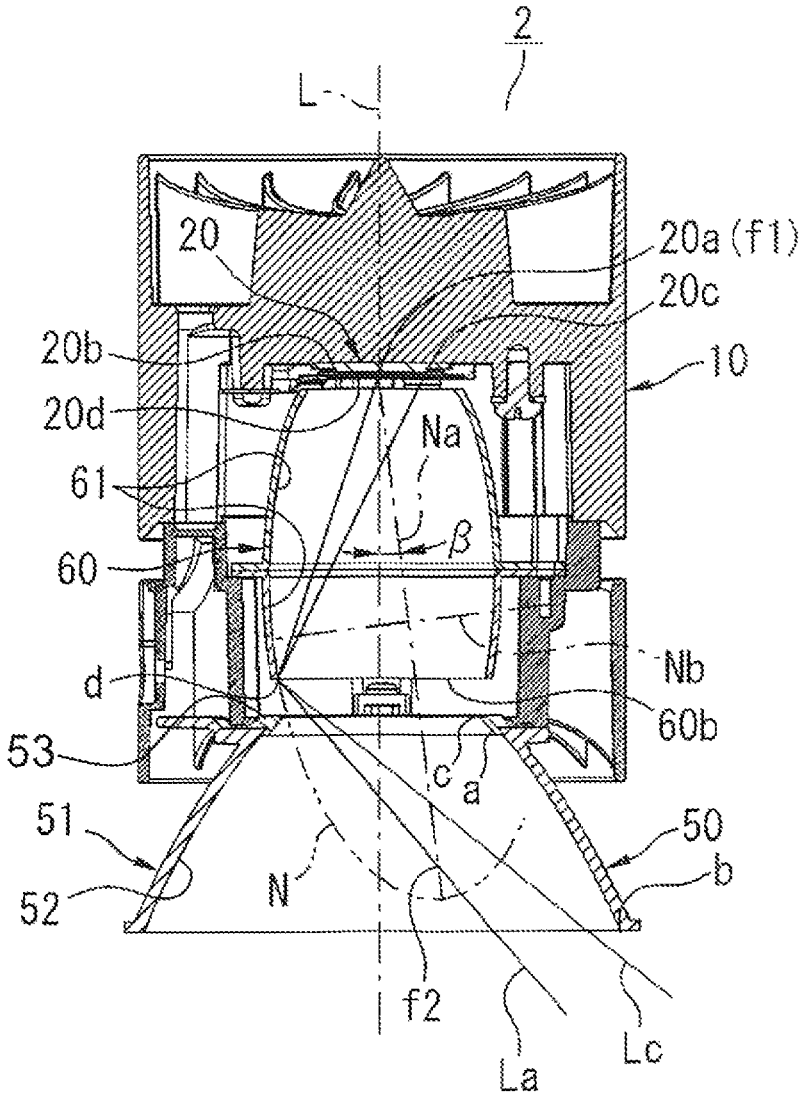
FIG. 7 illustrates a lighting apparatus 2 of Embodiment 2, which corresponds to FIG. 5 for Embodiment 1.

A lighting apparatus 2 according to Embodiment 2 is now described with reference to FIG. 7.

The lighting apparatus 2 in this embodiment comprises a reflector 60 that is different from the reflector 40 in the lighting apparatus 1 in Embodiment 1. The configuration of the lighting apparatus 2 other than reflector 60 is the same as that of the lighting apparatus 1.

The reflector 60 has a spheroidal shape. A spheroidal first reflection surface 61 is formed on an inner periphery surface of the reflector 60 throughout its entire surface.

The first reflection surface 61 is obtained by revolving a portion of an ellipse N, which is used as a base, around the optical axis L. The ellipse N has the major axis Na and the minor axis Nb. The major axis Na is inclined toward the other side (right side) with respect to the optical axis L by an angle 3. The first focal point f1 of the ellipse N coincides with the center 20*a* of the light-emitting surface 20*d* of the light source 20.

In this embodiment, a portion of the ellipse N that corresponds to one side (left side) with respect to the major axis Na is used as the portion of the ellipse N. In other words, when the ellipse N is divided into two equal parts along the major axis Na, a portion located in relatively lower side is used.

In this case, the angle, with respect to the level surface H (see FIG. 6), of the controlled reflection light La, Lc, which respectively goes out from the center 20*a* and the end portion 20*c* of the light-emitting surface 20*d* and is reflected in a portion in close proximity to the inner periphery edge d of light emission outlet 60 *b* of the reflector 60, gets smaller than a case where the major axis Na of the ellipse N is not inclined (the case the major axis Na is located on the optical axis L), and thus the reflection light La, Lc tend to be widened.

In the present embodiment, even when the major axis Na of the ellipse N is inclined as described above and the angle of reflection light La, Lc with respect to the level surface gets smaller, the controlled reflection light La, Lc will not hit the second reflection surface 52 of the cone 50.

In other words, the light source 20, reflector 60, and the cone 50 are configured so that the cone 50 is located outside the optical paths of the controlled reflection light La, Lc.

Effects and advantages of Embodiment 2 are substantially the same as those of Embodiment 1.

In Embodiment 1 described above, the major axis of the ellipse that is used as a base of the first reflection surface 41 coincides with the optical axis L. In Embodiment 2, the major axis Na of the ellipse N that is used as a base of the first reflection surface 61 is inclined by the angle β with respect to the optical axis L.

The present invention is not limited to these examples. For example, the major axis of an ellipse that is used as a base of the first reflection surface may be parallel to the optical axis L (except the case where the major axis coincides with the optical axis L).

In addition, the shape of the first reflection surfaces 41, 61 are not limited to a spheroid, and may be a similar shape, for example, a shape in which reflection light is collected near a focal point.

In addition, a paraboloid of revolution, for example, may be adopted instead of a spheroid. In that case, the center line of its parabola may be any of: coinciding with the optical axis L; being parallel to the optical axis L; or being inclined with respect to the optical axis L.

In addition, theoretically, the first reflection surfaces 41, 61 may have any shape as long as the cone 50 is disposed outside the optical path of the controlled reflection light that hits the first reflection surface 41 or 61 and is reflected from the first reflection surface 41 or 61.

DESCRIPTION OF REFERENCES IN DRAWINGS

1: lighting apparatus of Embodiment 1
2: lighting apparatus of Embodiment 2
10: socket
20: light source
20*d*: light-emitting surface
30: body
40, 60: reflector
40*a*: light incidence inlet
40*b*: light emission outlet

41, 61: first reflection surface
50: cone
50*a*: upper opening
50*b*: lower opening
51: cone body
52: second reflection surface
53: light-shielding member
a: inner periphery edge at an upper end of the cone body
b: inner periphery edge at a lower end of the cone body (inner periphery edge of the lower opening of the cone)
c: inner periphery edge of the light-shielding member (inner periphery edge of the upper opening of the cone)
d: inner periphery edge at a lower end of the reflector (inner periphery edge of the light emission outlet of the reflector)
Da: the diameter of the inner periphery edge a of the upper end of the cone body
Db: the diameter of the inner periphery edge b of the lower opening of the cone
Dc: the diameter of the inner periphery edge c of the upper opening of the cone
Dd: the diameter of the inner periphery edge d of the light emission outlet of the reflector
L: optical axis
M1: first reference line
M2: second reference line
α: angle range (region) between the first reference line and second reference line
θ: glare cut-off angle

The invention claimed is:

1. A lighting apparatus comprising:

a light source;

a reflector having a first reflection surface with a shape of a surface of revolution, and a downward light emission outlet through which direct light from the light source and reflection light from the first reflection surface being emitted; and a cone having a substantially truncated conical second reflection surface, an upper opening directly opposing the light emission outlet, and a lower opening having a diameter greater than a diameter of the upper opening, wherein the cone is disposed outside an optical path of controlled reflection light from the first reflection surface, in a cross section cut along a plane including an optical axis of the light source, an inner periphery edge of the upper opening is defined as a first inner periphery edge, and an inner periphery edge of the lower opening is defined as a second inner periphery edge, and a line connecting the first inner periphery edge and the second inner periphery edge on one side of the optical axis is defined as a first reference line, and a line connecting the first inner periphery edge and the second inner periphery edge on the other side of the optical axis is defined as a second reference line, wherein the light source comprises a planar light-emitting surface, and the light-emitting surface is disposed in a region interposed between the first reference line and the second reference line, after the first reference line and the second reference line extend from a cone side to a reflector side and intersect with each other.

2. The lighting apparatus according to claim 1, wherein the second reflection surface has a shape being linear or curved concave toward the optical axis, in the cross section.

3. The lighting apparatus according to claim 1, wherein the first reflection surface has a spheroidal shape obtained by revolving a portion of an ellipse that has its major axis on the optical axis, wherein an upper first focal point is disposed at the center of the light-emitting surface, and a lower second focal point is disposed lower than the upper opening of the cone.

4. The lighting apparatus according to claim 1, wherein the diameter of an inner periphery edge of the light emission outlet of the reflector and the diameter of the first inner periphery edge of the cone are set to be substantially the same.

5. The lighting apparatus according to claim 4, wherein the cone comprises a cone body having the second reflection surface, and a ring shaped light-shielding member covering an inner periphery edge at an upper end of the cone body, and wherein the diameter of the inner periphery edge of the light emission outlet is smaller than the diameter of an inner periphery edge at an upper end of the cone body, and greater than the diameter of an inner periphery edge of the light-shielding member that configures the first inner periphery edge.

* * * * *